US010023443B2

(12) United States Patent
Herse et al.

(10) Patent No.: US 10,023,443 B2
(45) Date of Patent: Jul. 17, 2018

(54) TOWER CRANE AND METHOD OF MOUNTING A WIND TURBINE ROTOR BLADE

(71) Applicant: Liebherr-Werk Biberach GmbH, Biberach an der Riss (DE)

(72) Inventors: Thomas Herse, Biberach (DE); Norbert Stanger, Attenweiler (DE); Christoph Eiwan, Ummendorf (DE)

(73) Assignee: Liebherr-Werk Biberach GmbH, Biberach an der Riss (DE)

( * ) Notice: Subject to any disclaimer, the term of this patent is extended or adjusted under 35 U.S.C. 154(b) by 237 days.

(21) Appl. No.: 14/901,824

(22) PCT Filed: Jul. 1, 2014

(86) PCT No.: PCT/EP2014/001797
§ 371 (c)(1),
(2) Date: Dec. 29, 2015

(87) PCT Pub. No.: WO2015/000586
PCT Pub. Date: Jan. 8, 2015

(65) Prior Publication Data

US 2016/0229671 A1 Aug. 11, 2016

(30) Foreign Application Priority Data

Jul. 1, 2013 (DE) ..... 10 2013 010 965
Mar. 19, 2014 (DE) ..... 10 2014 003 906

(51) Int. Cl.
*B66C 13/08* (2006.01)
*B66C 23/18* (2006.01)
(Continued)

(52) U.S. Cl.
CPC ..... *B66C 23/185* (2013.01); *B66C 13/08* (2013.01); *B66C 23/16* (2013.01); *B66C 23/207* (2013.01)

(58) Field of Classification Search
CPC ..... B66C 13/08; B66C 23/16; B66C 23/163; B66C 23/185; B66C 23/207
See application file for complete search history.

(56) References Cited

U.S. PATENT DOCUMENTS 5,241,797 A * 9/1993 Cliff ..... E04H 12/30 52/192
7,207,777 B2 * 4/2007 Bervang ..... B66C 1/108 416/119
(Continued)

FOREIGN PATENT DOCUMENTS

DE 29908395 U1 9/1999
DE 202011100477 U1 8/2012
(Continued)

OTHER PUBLICATIONS

ISA European Patent Office, International Search Report Issued in Application No. PCT/EP2014/001797, dated Oct. 21, 2014, WIPO, 3 pages.

*Primary Examiner* — Emmanuel M Marcelo
(74) *Attorney, Agent, or Firm* — McCoy Russell LLP

(57) ABSTRACT

The invention relates to a tower crane comprising a tower of at least one tower element, in particular a lattice piece, and a structural guying device having at least one guying rod for the horizontal anchorage of the tower at a structure. In accordance with the invention, the tower has a vertically adjustable guide frame, wherein at least one positioning rope is adjustably fastened to the guide frame. The invention furthermore relates to a method of mounting a wind turbine rotor blade.

16 Claims, 5 Drawing Sheets

(51) Int. Cl.
*B66C 23/20* (2006.01)
*B66C 23/16* (2006.01)

(56) References Cited

U.S. PATENT DOCUMENTS

| | | | | |
|---|---|---|---|---|
| 8,794,457 | B2 * | 8/2014 | Richter | B66C 13/08 212/256 |
| 8,944,262 | B2 * | 2/2015 | Willim | B66C 23/185 212/273 |
| 2008/0216301 | A1 * | 9/2008 | Hansen | B66C 1/108 29/428 |
| 2011/0094987 | A1 * | 4/2011 | Botwright | B66C 1/108 212/274 |
| 2011/0221215 | A1 * | 9/2011 | Botwright | B66C 1/108 294/81.4 |
| 2014/0076835 | A1 * | 3/2014 | Herse | B66C 23/207 212/223 |

FOREIGN PATENT DOCUMENTS

| | | | | |
|---|---|---|---|---|
| DE | 102011015881 | A1 | 10/2012 | |
| EP | 2364949 | A1 | 9/2011 | |
| GB | 221399 | A | 9/1924 | |
| NL | 1008402 | C2 | 8/1999 | |
| WO | WO 2012/163906 | A1 * | 5/2012 | B66C 23/20 |

* cited by examiner

TOWER CRANE AND METHOD OF MOUNTING A WIND TURBINE ROTOR BLADE

CROSS REFERENCE TO RELATED APPLICATIONS

The present application is a U.S. National Phase of International Patent Application Ser. No. PCT/EP2014/001797, entitled "Tower Crane and Method of Mounting a Wind Turbine Rotor Blade," filed on Jul. 1, 2014, which claims priority to German Patent Application No. 10 2014 003 906.4, filed on Mar. 19, 2014, and to German Patent Application No. 10 2013 010 965.5, filed Jul. 1, 2013, the entire contents of each of which are hereby incorporated by reference in their entirety for all purposes.

TECHNICAL FIELD

The invention relates to a tower crane having a tower comprising at least one tower element and a structural guying device having at least one guying rod for a horizontal anchorage of the tower at a structure. The invention furthermore relates to a method of mounting a wind turbine rotor blade.

BACKGROUND AND SUMMARY

With tower cranes in which the tower comprises one or more tower elements which are connected to one another in the vertical direction, the height of the tower can be increased by the use of further tower elements. However, tower cranes have a maximum free-standing hook height. If the latter is exceeded, the tower crane has to be fastened to the structure to be erected by a horizontal anchorage. The maximum achievable hook height can hereby be considerably increased.

It is possible with such tower cranes to have the tower crane grow with the structure by the installation of further tower elements, with the stability of the tower crane being ensured by one or more structural guying devices. A tower crane having such a structural guying device is already known from DE 20 2011 100 477 U.

Such tower cranes having a structural guying device are used, for example, for erecting wind power stations. When installing such wind power stations, the rotor blades have to be guided by the crane during the installation. The rotor blades are guided as standard by ropes from the ground during the installation. The rope tension forces which can be applied by such a ground guidance are very low so that only very small wind speeds can be permitted on such an installation. Furthermore, space problems often result in the guidance of the ropes from the ground if, for example, the wind power station is set up in a wood area in which the space relationships are very restricted in part.

It is therefore the object of the present invention to further develop a tower crane of the category such that long objects such as rotor blades can be guided in very high heights during the installation.

This object is achieved with the invention by means of a tower crane comprising a tower with at least one tower element and a structural guying device having at least one guying rod for a horizontal anchorage of the tower at a structure, wherein a guide frame is arranged vertically movably at the tower; wherein at least one positioning rope is adjustably fastened to the guide frame.

A tower crane accordingly has a tower composed of at least one tower element, in particular a lattice piece, preferably having a structural guying device which is anchored to a structure by at least one guying rod with respect to the horizontal and which has a guide frame which is vertically movable at the tower, with at least one positioning rope being adjustably fastened to the guide frame. The distance between the element to be guided, for example the rotor blade, and the guide point can be considerably reduced via this positioning part which is adjustably fastened to the guide frame so that the object to be mounted can be guided in a substantially more stable manner. The guide frame can respectively be vertically repositioned in height at the tower. Guidance can hereby takes place completely independently of the space relationships on the ground. Furthermore, an installation can also take place at comparatively higher wind speeds.

Preferred embodiments of the invention result from the dependent claims following on from the main claim.

The guide frame can preferably be vertically readjustable along the guide frame via at least one rope guide.

The at least one rope guide has a rope drum arranged at the tower and a deflection pulley arranged at a climb piece or at the guide piece. Two rope guides are preferably present for moving the guide frame and can be adjustable via a two-rope winch having two rope drums.

The guide frame is configured in U shape in accordance with an advantageous embodiment of the invention so that it engages around the tower at three sides.

To achieve an even higher stability and to prevent a lifting of the U-shaped guide frame from the tower, the U-shaped guide frame is preferably angled at its open end to engage around the corner regions of the tower.

The guide frame particularly advantageously has roller bearings or slide bearings in the corner regions of the tower and is supported thereon during the vertical upward and downward movement with respect to the tower. Since the weight of the guide frame is very high due to its stable design, the guide frame can be separable for the purpose of installation and transportation.

A winch is arranged at the guide frame for the adjustment of the at least one positioning rope. Two ends which are controllable independently of one another are advantageously provided for the independent adjustment of two positioning ropes.

In addition, telescopic struts can be arranged at the guide frame which serve, on the one hand, for guiding the positioning ropes and which serve, on the other hand, as dampers if a contact of the object to be guided, for example the rotor blade, and of the struts occurs.

In accordance with a particularly advantageous embodiment of the invention, the guide points for the positioning ropes provided at the guide frame are rotatable about the tower. Suitable guides are provided at the guide frame for this purpose.

The guide frame can additionally serve as a passenger elevator and/or goods elevator. However, two independent rope guides for a vertical displacement of the guide frame are required here for use as a passenger elevator.

A compensation weight is preferably provided for a weight compensation during the vertical movement of the guide frame, in a similar manner as is known from conventional elevator technology.

The invention furthermore comprises a method of mounting a wind turbine rotor blade to a wind turbine rotor hub using a tower crane comprising a tower with at least one tower element with a structural guying device having at least one guying rod for a horizontal anchorage of the tower, wherein a guide frame is arranged vertically movably at the tower, and wherein at least one positioning rope is adjustably fastened to the guide frame; wherein the rotor blade is aligned with the positioning ropes starting from the guide frame.

Further details, features and advantages of the invention result from the embodiments shown in the enclosed drawings.

DETAILED DESCRIPTION

Figure 1:
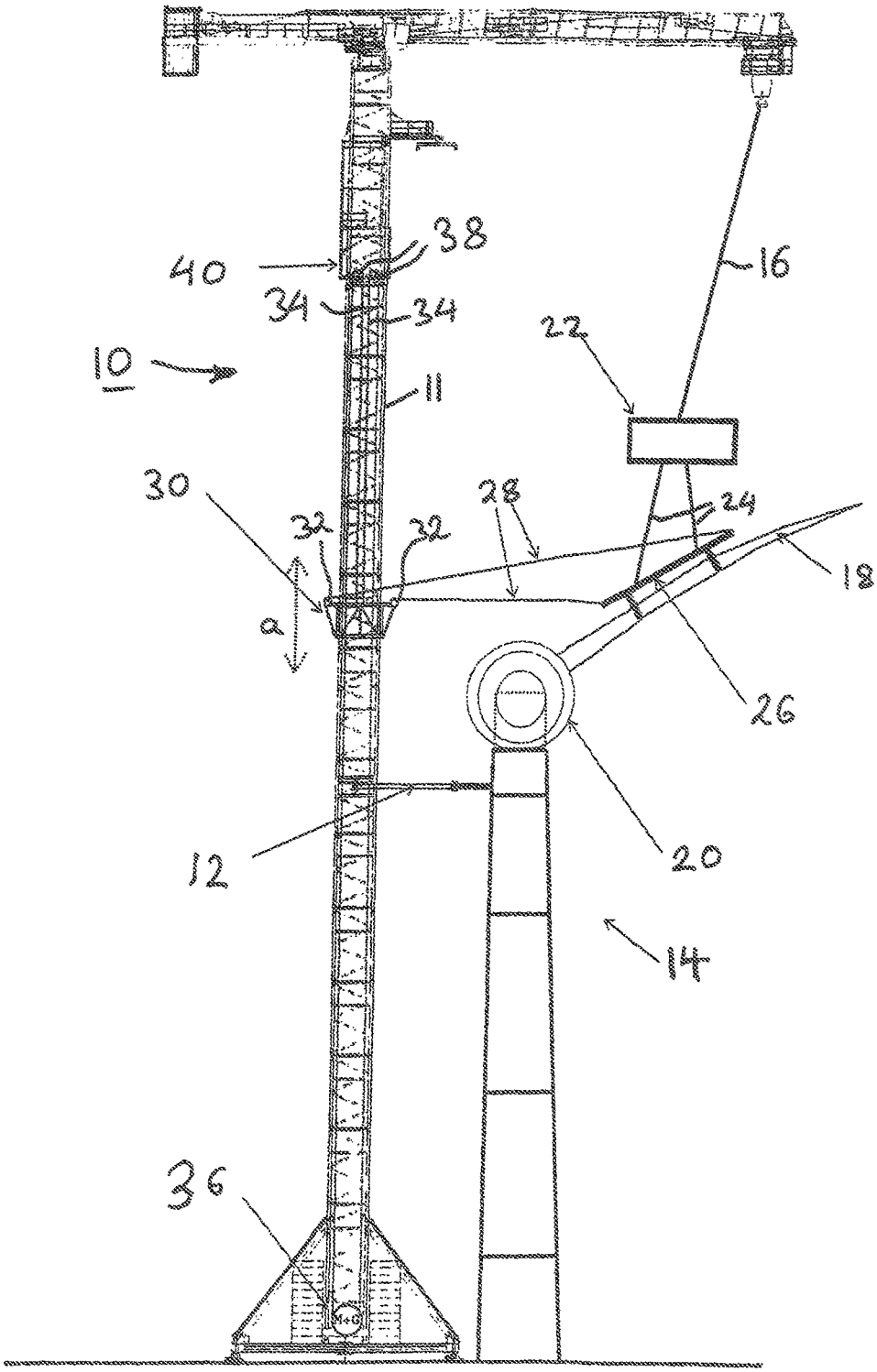
FIG. 1 shows a tower crane in accordance with the present invention during the installation of a wind power station.

FIG. 1 shows a tower crane 10 which is connected via a structural guying device 12 known per se to a wind power station 14 to be erected. The tower crane 10 serves the setting up of the wind power station. In the embodiment shown here, a rotor blade 18 of the tower crane is received via a load rope 16 of the tower crane 10 to mount said rotor blade to the hub 20 of the wind power station.

In this respect, the load rope 16 is connected in the embodiment shown here to an adjustment unit 22 which has winches for the pitch and roll angle adjustment of the received rotor blade 18. The rotor blade 18 is connected via corresponding ropes 24 to a rotor blade gripper 26 by means of which the rotor blade 18 can be engaged around in a known manner.

Two positioning ropes 28 are connected in an articulated manner to the rotor blade gripper 26 and their other ends are fastened to a guide frame 30. The guide frame 30 is movable vertically along the tower 11 of the tower crane in the direction of the double arrow a. The lengths of the positioning ropes 28 can be adjusted via corresponding winches 32.

The vertical adjustment of the guide frame 30 takes place via two ropes 34 in the embodiment shown here which can be moved via a drive 36. The drive 36 in the embodiment shown here is arranged in the ground region of the tower crane 10. The drive here comprises a two-rope winch having two rope drums. The ropes 34 are guided via deflection pulleys 38 which are provided in a crane tower climbing unit 40.

Figure 2:
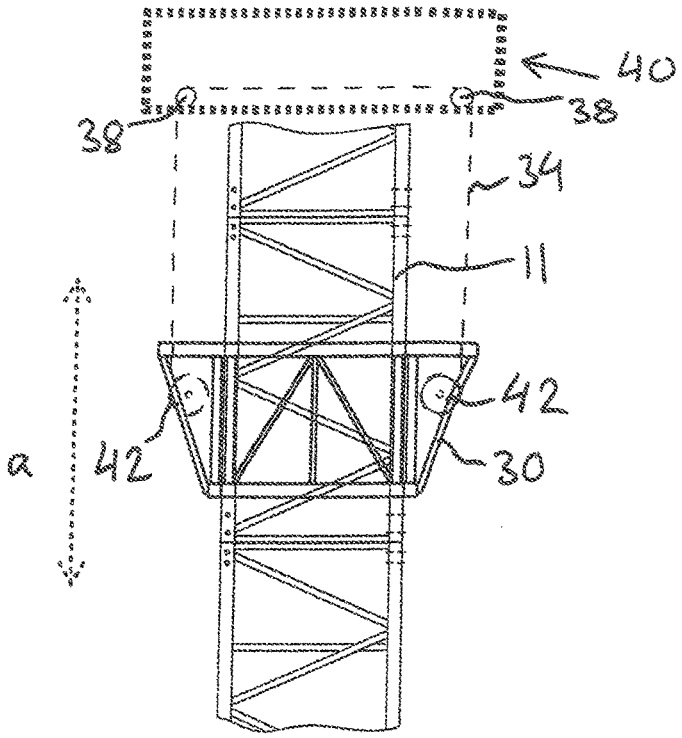
FIG. 2 shows a detail of the tower crane in accordance with FIG. 1 in a slightly modified embodiment in a side view and in a plan view.

A slightly modified variant from FIG. 1 is shown in the detailed representation in accordance with FIG. 2. Here, the guide frame 30 movable in the direction of the double arrow a is shown at the tower 11, with a rope 34 serving here for the vertical displacement and in turn being guided via deflection pulleys 38 of a crane tower climbing device 40. This rope 34, however, runs over corresponding winches 42 which are arranged in the guide frame 30. The rope 34 is extended or shortened in length by the adjustment of the winches 42 so that the vertical movement of the guide frame 30 is executed here.

Figure 3:
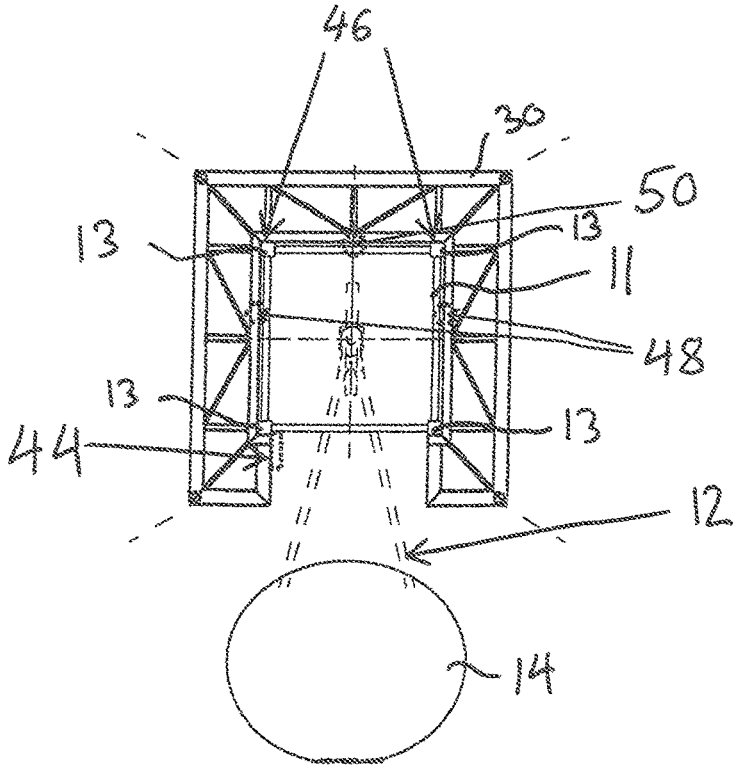

FIG. 3 shows a cross-sectional view of the guide frame 30 from which the arrangement with respect to the tower 11 of the tower crane becomes clear. The tower 11 is connected to the wind power station 14 via a structural guying device 12.

The guide frame 30 has a U shape as is shown in FIG. 3. The U-shaped guide frame 30 is, however, angled at its open end to engage around the corner regions of the tower, as is illustrated at the position number 44. Roller bearings or slide bearings 46, which are not shown in detail here, are provided in the guide frame in the region of the corner bars 13 of the tower 11. The roller bearing guide or slide bearing guide not shown in detail here in FIG. 3 can be configured as pivotable toward the tower to simplify the installation.

48 shows two points of engagement of the positioning ropes 28. In the event that only one positioning rope is used, the point of engagement 50 is to be selected.

Figure 4:
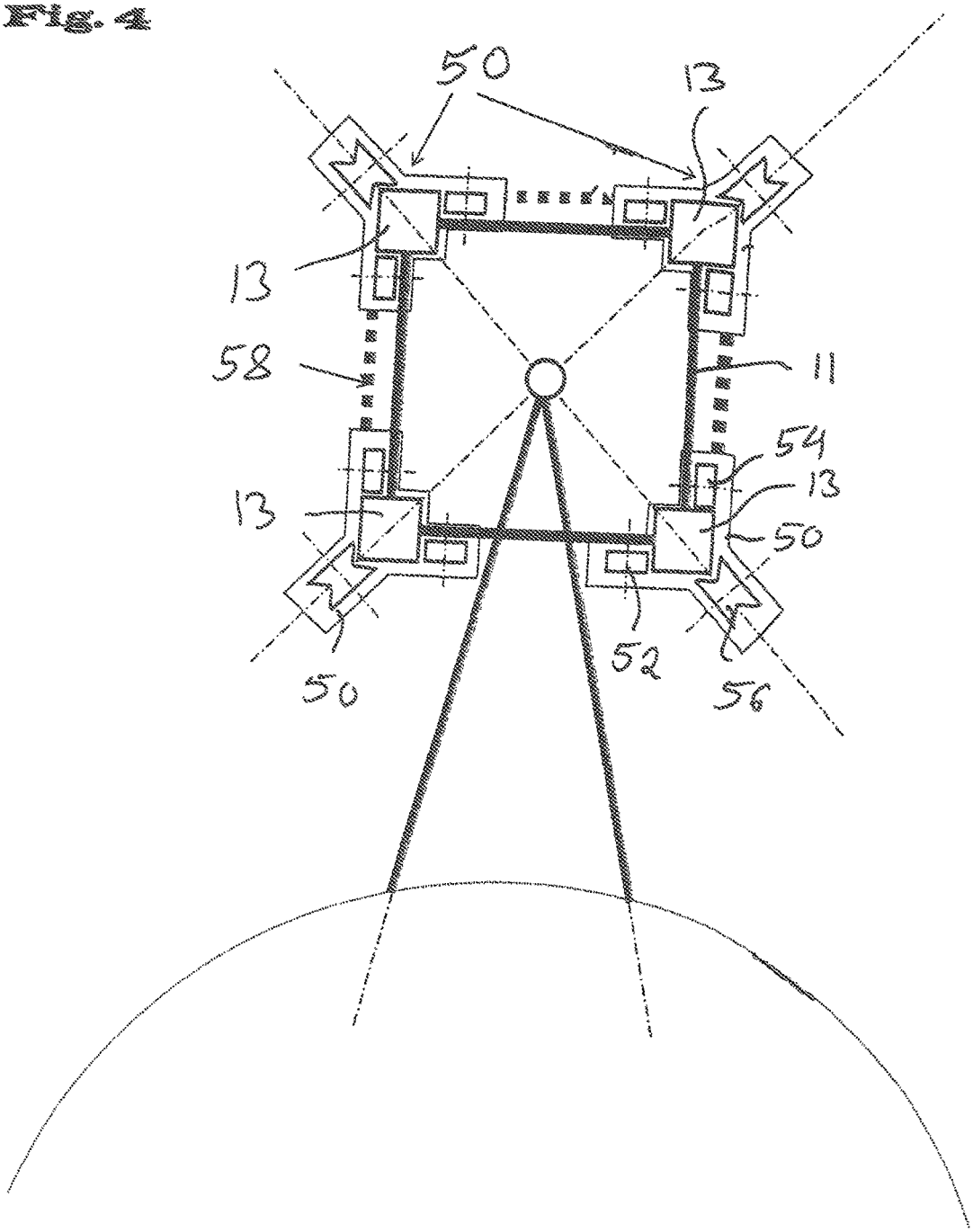
FIG. 4 shows an alternative embodiment of the guide frame.

An alternative embodiment of the guide frame is shown in FIG. 4. Here, the guide frame has corner guide elements 50 which are placed onto the respective corner bars 13 of the tower 11. The corner guide elements each include three roller bearings 52, 54 and 56. They are respectively connected to one another via connection elements 58.

In the embodiment shown here, the invention has been described with reference to a more stable guidance of a rotor blade. Any other desired large and planar body can naturally also be brought into a corresponding mounting position instead of a rotor blade within the framework of the invention. The invention is therefore not restricted to the installation of wind power stations.

In the embodiment shown here, the positioning ropes 28 are connected in a pivotable manner to the rotor blade grippers. The positioning ropes can naturally also be lashed directly to the rotor or to another component to be positioned.

Figure 5:
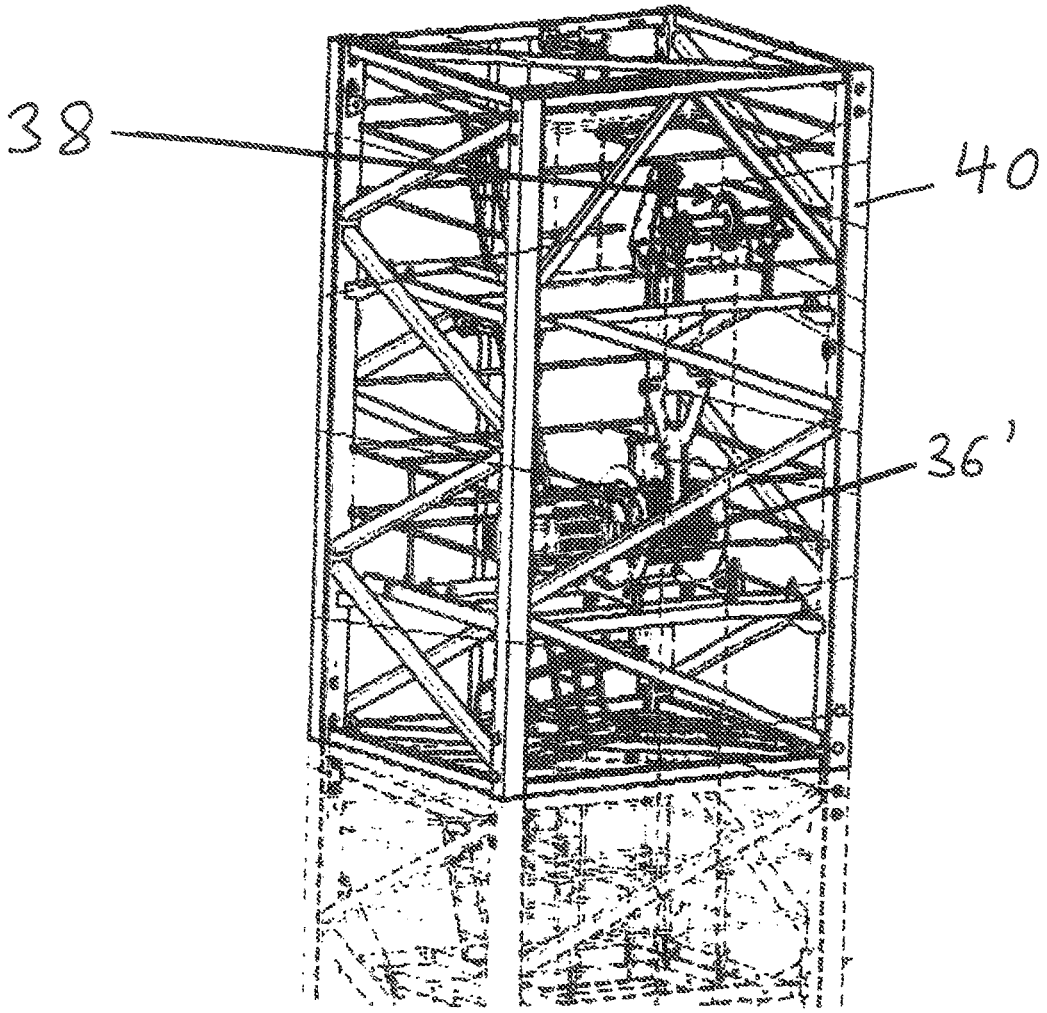
FIG. 5 shows a detailed view of a tower piece of the tower crane in accordance with the invention.

FIG. 5 shows a crane tower climbing device 40 in accordance with a further embodiment of the invention. It is inserted as the last tower piece and thus always remains at the topmost position at the tower crane 10. The position of the deflection pulley 38 and of a hoisting gear 36' for the vertical movement of the guide frame 30 is shown here.

The alignment of the rotor blade can take place in an advantageous manner via the guide frame 30 arranged at the tower 11 using the previously described tower crane 10 in the setting up of a wind power station. The crane operator can in this respect have a remote control and a camera for the vertical guidance of the rotor blade or of the attachment part. The crane operator likewise has a remote control and a camera as well as a control for moving the positioning ropes 28 for the horizontal guidance or alignment of the rotor blade. The pitch and roll angle adjustment of the rotor blade along a longitudinal axis is taken over by the adjustment unit 22 in this respect.

Figure 6:
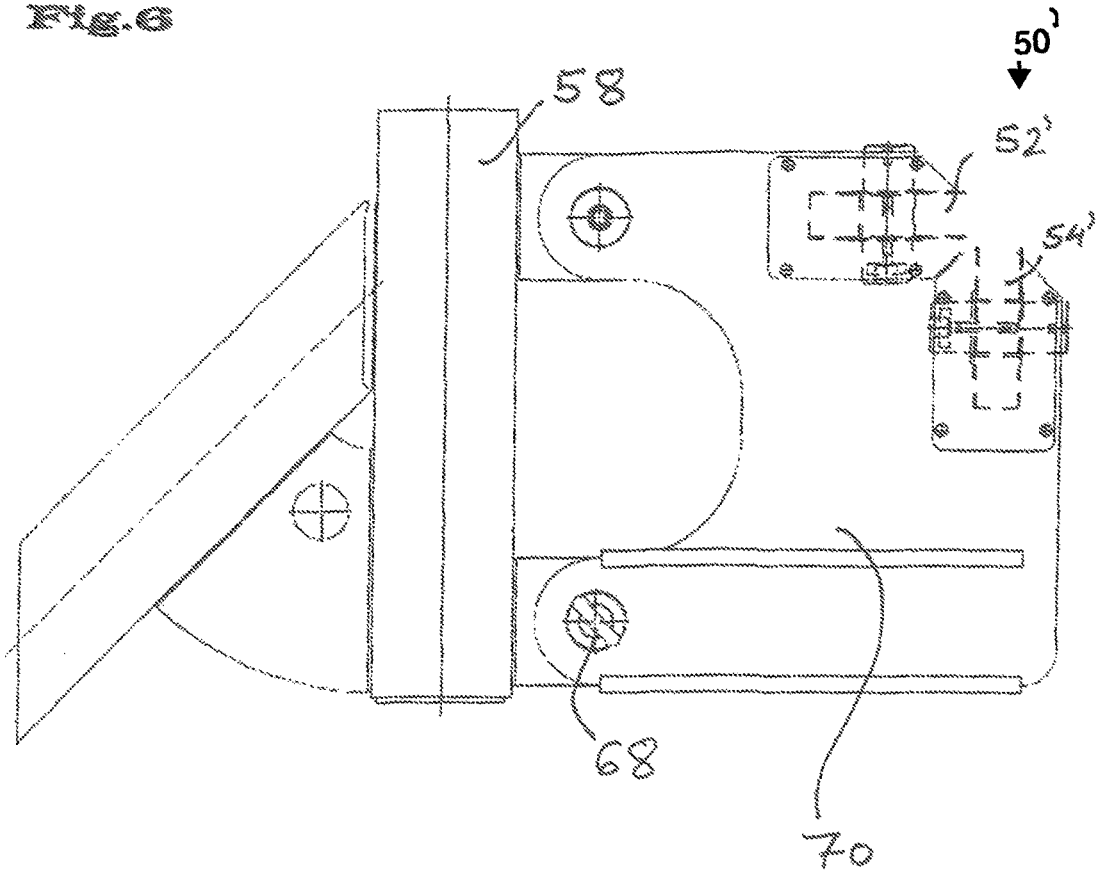
FIG. 6 shows a detailed representation of a part of another alternative embodiment of a guide frame.
Figure 7:
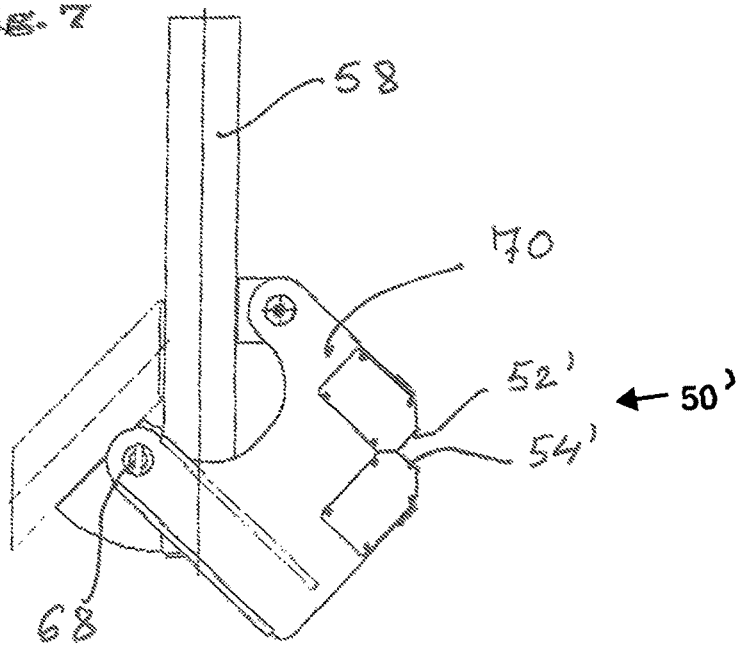
FIG. 7 shows a detailed representation of a part of another alternative embodiment of a guide frame.

Finally, FIGS. 6 and 7 show details of a guide frame 30 of modification construction with modified corner guide elements 50'. The corner guide elements 50' shown here each have two roller bearings 52' and 54' which are placed onto corner bars 13, not shown, of the tower 11.

The roller bearings 52' and 54' are supported in a pivotal metal sheet 70 for a simple installation. In FIG. 7, the sheet metal is pivoted into an installation position in which it can be secured by a pin 68. The guide frame can be brought up to the corner bars 13 of the tower 11 in this installation position. The metal sheet 70 can then be brought into the final installed position by pivoting it and can be bolted there again as shown in FIG. 6. In this position, the roller bearings 52' and 54' are in contact with the corner bars 13. The guide frame can be mounted simply thanks to this construction design.

The invention claimed is:

1. A tower crane comprising a tower with at least one tower element and a structural guying device having at least one guying rod for a horizontal anchorage of the tower at a structure;

wherein a guide frame is arranged vertically movably at the tower; wherein at least one positioning rope is adjustably fastened to the guide frame; and wherein the guide frame is a U shape to engage around the tower at three sides.

2. The tower crane in accordance with claim 1, wherein the guide frame is vertically adjustable along the tower via at least one rope guide.

3. The tower crane in accordance with claim 2, wherein the at least one rope guide has a rope drum arranged at the tower and a deflection pulley arranged at a climb piece or in a guide piece.

4. The tower crane in accordance with claim 2, wherein two rope guides are present for moving the guide frame and are adjustable with a two-rope winch having two rope drums.

5. The tower crane in accordance with claim 1, wherein the U-shaped guide frame is angled at its open end to engage around corner regions of the tower.

6. The tower crane in accordance with claim 1, wherein the guide frame is guided over rollers or slide bearings in corner regions of the tower.

7. The tower crane in accordance with claim 1, wherein the guide frame is separable for installation and transportation.

8. The tower crane in accordance with claim 1, wherein a winch is arranged at the guide frame for adjustment of the at least one positioning rope.

9. The tower crane in accordance with claim 1, wherein telescopic struts are arranged at the guide frame for the guidance of the at least one positioning rope and/or as dampers.

10. The tower crane in accordance with claim 1, wherein guide points for the at least one positioning rope provided at the guide frame rotate about the tower.

11. The tower crane in accordance with claim 1, wherein the guide frame serves as a passenger elevator and/or as a goods elevator.

12. The tower crane in accordance with claim 1, wherein a compensation weight is provided for weight compensation on a vertical movement of the guide frame.

13. The tower crane in accordance with claim 1, wherein the at least one tower element is a lattice piece.

14. The tower crane in accordance with claim 1, wherein two winches controllable independently of one another are provided for an independent adjustment of two positioning ropes.

15. A method of mounting a wind turbine rotor blade to a wind turbine rotor hub using a tower crane comprising a tower with at least one tower element with a structural guying device having at least one guying rod for a horizontal anchorage of the tower, wherein a U-shaped guide frame is arranged vertically movably at the tower, and wherein at least one positioning rope is adjustably fastened to the guide frame;

wherein the U-shaped guide frame engages around the tower at three sides; and wherein the rotor blade is aligned with the at least one positioning rope starting from the guide frame.

16. The method in accordance with claim 15, wherein the rotor blade is received by a rotor blade gripper arranged at an adjustment unit;

wherein a vertical guidance of the rotor blade takes place via a load rope at which the adjustment unit is suspended;

wherein a horizontal guidance or alignment of the rotor blade takes place via the at least one positioning rope; and wherein a pitch and roll angle adjustment of the rotor blade along its longitudinal axis takes place via the adjustment unit.

* * * * *